US006757003B1

(12) United States Patent
Gao et al.

(10) Patent No.: US 6,757,003 B1
(45) Date of Patent: Jun. 29, 2004

(54) PREVENTING CREASE FORMATION IN DONOR WEB IN DYE TRANSFER PRINTER THAT CAN CAUSE LINE ARTIFACT ON PRINT

(75) Inventors: Zhanjun J. Gao, Rochester, NY (US); John F. Corman, Rochester, NY (US); Robert F. Mindler, Churchville, NY (US); Po-Jen Shih, Webster, NY (US); Theodore J. Skomsky, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/391,175

(22) Filed: Mar. 18, 2003

(51) Int. Cl.[7] ..... B41J 11/04
(52) U.S. Cl. ..... 347/220; 400/661.3
(58) Field of Search ..... 347/220, 217; 400/648, 659, 661.3, 234, 662

(56) References Cited

U.S. PATENT DOCUMENTS 6,380,964 B1 * 4/2002 Tanaka ..... 347/216

FOREIGN PATENT DOCUMENTS

| | | | | |
|---|---|---|---|---|
| JP | 01-110175 | * | 4/1989 | ..... B41J/17/30 |
| JP | 06-171170 | * | 6/1994 | ..... B41J/13/02 |
| JP | 08-230262 | * | 9/1996 | ..... B41J/17/30 |
| JP | 09-039349 | * | 2/1997 | ..... B41J/17/30 |

* cited by examiner

*Primary Examiner*—Huan Tran
(74) *Attorney, Agent, or Firm*—Roger A. Fields

(57) ABSTRACT

A thermal printer is adapted to prevent crease formation in a dye transfer area of a dye donor web that can cause line artifacts to be printed on a dye receiver during a dye transfer from the dye transfer area to the dye receiver in a dye transfer printer.

10 Claims, 10 Drawing Sheets

1

PREVENTING CREASE FORMATION IN DONOR WEB IN DYE TRANSFER PRINTER THAT CAN CAUSE LINE ARTIFACT ON PRINT

FIELD OF THE INVENTION

The invention relates generally to dye transfer printers such as thermal printers, and in particular to the problem of crease or wrinkle formation in successive dye transfer areas of the donor web. Crease formation in the dye transfer area can result in an undesirable line artifact being printed on a dye receiver.

BACKGROUND OF THE INVENTION

A typical multi-color dye donor web that is used in a thermal printer is substantially thin and has a repeating series of three different rectangular-shaped color sections or patches such as a yellow color section, a magenta color section and a cyan color section. Also, there may be a transparent colorless laminating section immediately after the cyan color section.

Each color section of the dye donor web consists of a dye transfer area that is used for dye transfer printing and a pair of opposite longitudinal edge areas alongside the dye transfer area which are not used for printing. The dye transfer area is about 95% of the web width and the two edge areas are each about 2.5% of the web width.

To make a multi-color image print using a thermal printer, a motorized donor take-up spool pulls the dye donor web from a donor supply spool in order to successively advance an unused single series of yellow, magenta and cyan color sections over a stationary bead of selectively heated resistive elements on a thermal print head between the two spools. Respective color dyes within the yellow, magenta and cyan color sections are successively heat-transferred via the bead of selectively heated resistive elements, in superimposed relation, onto a dye receiver such as a paper or transparency sheet or roll, to form the color image print. The bead of resistive elements extends across the entire width of a color section, i.e. across its dye transfer area and the two edge areas alongside the transfer area. However, only those resistive elements that contact the dye transfer area are selectively heated. Those resistive elements that contact the two edge areas are not heated. In other words, the dye transfer is effected from the dye transfer area to the receiver medium, but not from the two edge areas to the receiver medium.

As each color section, including its dye transfer area and the two edge areas alongside the transfer area, is advanced over the bead of selectively heated resistive elements, the color section is subjected to a longitudinal tension particularly by a pulling force of the motorized donor take-up spool. Since the dye transfer area is heated by the resistive elements, but the two edge areas alongside the transfer area are not, the transfer area is significantly weakened and vulnerable to stretching as compared to the edge areas. Consequently, the longitudinal tension will stretch the dye transfer area relative to the two edge areas. This stretching causes the dye transfer area to become thinner than the non-stretched edge areas, which in turn causes creases or wrinkles to develop in the transfer area, particularly in those regions of the transfer area that are close to the edge areas. The longitudinal creases or wrinkles are most notable in the regions of the dye transfer area that are close to the two edge areas because of the sharp, i.e. abrupt, transition between the weakened transfer area and the stronger edge areas.

As the donor web is advanced, the creases or wrinkles tend to spread or extend from a trailing or rear end portion of a used dye transfer area at least to a leading or front end portion of the next dye transfer area to be used. A problem that can result is that a crease or wrinkle in the leading or front end portion of the next dye transfer area to be used will cause an undesirable line artifact to be printed on a leading or front end portion of the dye receiver when dye transfer occurs at the crease. The line artifact printed on the dye receiver is relatively short, but quite visible.

The question presented therefore is how to solve the problem of the creases or wrinkles being created in an unused transfer area so that no line artifacts are printed on the dye receiver.

SUMMARY OF THE INVENTION

According to one aspect of the invention, there is provided a method of preventing crease formation in a dye transfer area of a dye donor web that can cause line artifacts to be printed on a dye receiver during a dye transfer from the dye transfer area to the dye receiver in a dye transfer printer. The method comprises:

heating the dye transfer area of the dye donor web sufficiently to effect a dye transfer from the dye transfer area to the dye receiver, and not heating opposite edge areas of the dye donor web alongside the dye transfer area sufficiently to effect a dye transfer from the edge areas to the dye receiver, but which therefore causes the dye transfer area to become more susceptible to being stretched than the edge areas; and mechanically causing the edge areas to be stretched substantially the same as the dye transfer area, when the dye transfer area and edge areas are subjected to a pulling force that tends to stretch the dye transfer area and edge areas, to avoid a reduction in stretching from the dye transfer area to the edge areas that would form creases in the dye transfer area which can cause line artifacts to be printed on the receiver medium.

According to another aspect of the invention, there is provided a thermal printer capable preventing crease formation in a dye transfer area of a dye donor web that can cause line artifacts to be printed on a dye receiver during a dye transfer from the dye transfer area to the dye receiver. The thermal printer comprises:

a thermal print head adapted to heat the dye transfer area of the dye donor web sufficiently to effect a dye transfer from the dye transfer area to the dye receiver, and not heat opposite edge areas of the dye donor web alongside the dye transfer area sufficiently to effect a dye transfer from the edge areas to the dye receiver, but which therefore causes the dye transfer area to become more susceptible to being stretched than the edge areas; and a platen roller that holds the dye transfer area and the edge areas against the thermal print head during the dye transfer from the dye transfer area to the dye receiver, and which is adapted to mechanically cause the edge areas to be stretched substantially the same as the dye transfer area, when the dye transfer area and edge areas are subjected to a pulling force that tends to stretch the dye transfer area and edge areas, to avoid a reduction in stretching from the dye transfer area to the edge areas that would form creases in the dye transfer area which can cause line artifacts to be printed on the receiver medium.

DETAILED DESCRIPTION OF THE INVENTION

Donor Web

Figure 1:
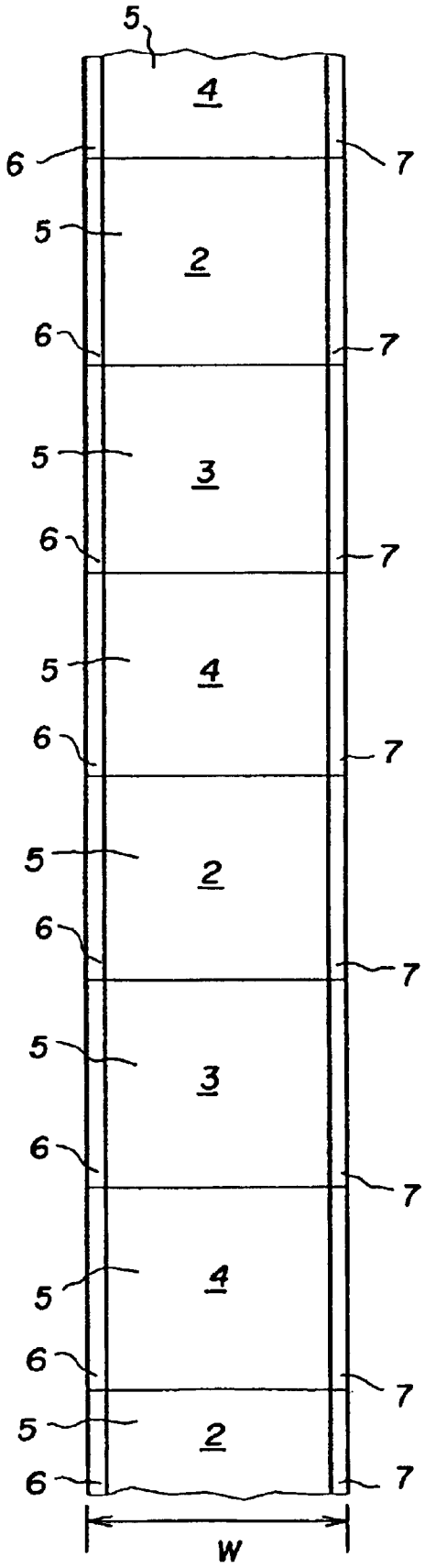
FIG. 1 is plan view of a typical donor web including successive dye transfer areas and opposite longitudinal edge areas alongside each one of the dye transfer areas.

FIG. 1 depicts a typical multi-color dye donor web or ink ribbon 1 that is used in a thermal printer. The donor web 1 is substantially thin and has a repeating series (only two completely shown) of three different rectangular-shaped color sections or patches such as a yellow color section 2, a magenta color section 3 and a cyan color section 4. Also, there may be a transparent laminating section (not shown) immediately after the cyan color section 4.

Each yellow, magenta or cyan color section 2, 3 and 4 of the dye donor web 1 consists of a yellow, magenta or cyan dye transfer area 5 that is used for printing and a pair of similar-colored opposite longitudinal edge areas 6 and 7 alongside the dye transfer area which are not used for printing. The dye transfer area 5 is about 95% of the web width W and the two edge areas 6 and 7 are each about 2.5% of the web width. See FIG. 1.

Dye Transfer Printer

FIGS. 2–6 depict operation of a thermal printer 10 using the dye donor web 1 to effect successive yellow, magenta and cyan dye transfers, in superimposed relation, onto a known dye receiver sheet 12 such as paper or a transparency.

Initialization

Figure 2:
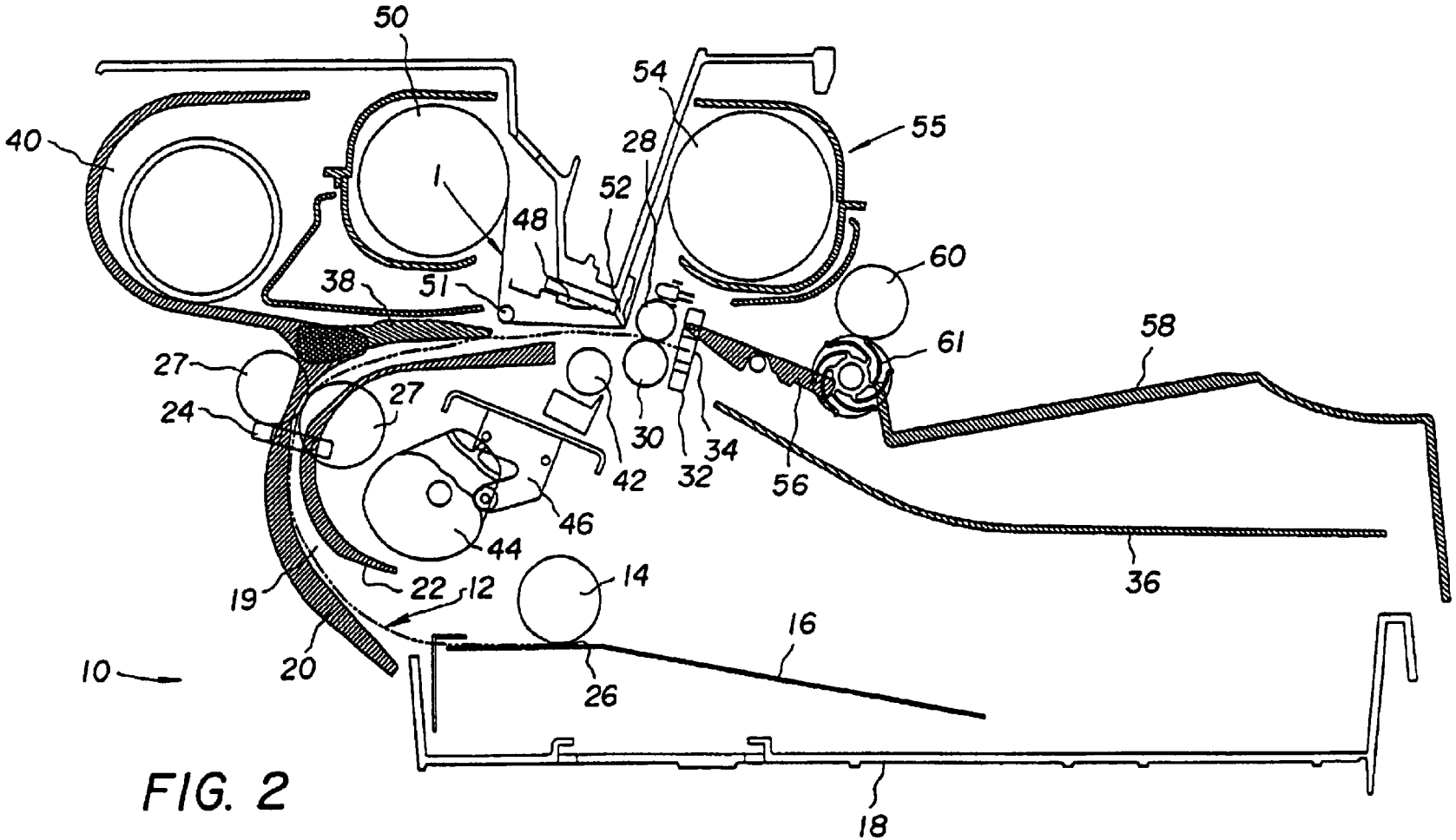
FIG. 2 is an elevation section view, partly in section, of a dye transfer printer, showing a beginning or initialization cycle during a printer operation.

Beginning with FIG. 2, the dye receiver sheet 12 is initially advanced forward via motorized coaxial pick rollers 14 (only one shown) off a floating platen 16 in a tray 18 and into a channel 19 defined by a pair of curved longitudinal guides 20 and 22. When a trailing (rear) edge sensor 24 midway in the channel 19 senses a trailing or rear edge 26 of the receiver sheet 12, it activates at least one of pair of motorized parallel-axis urge rollers 27, 27 in the channel 19. The activated rollers 27, 27 advance the receiver sheet 12 forward (to the right in FIG. 2) through the nip of a motorized capstan roller 28 and a pinch roller 30, positioned beyond the channel 19, and to a leading (front) edge sensor 32.

Figure 3:
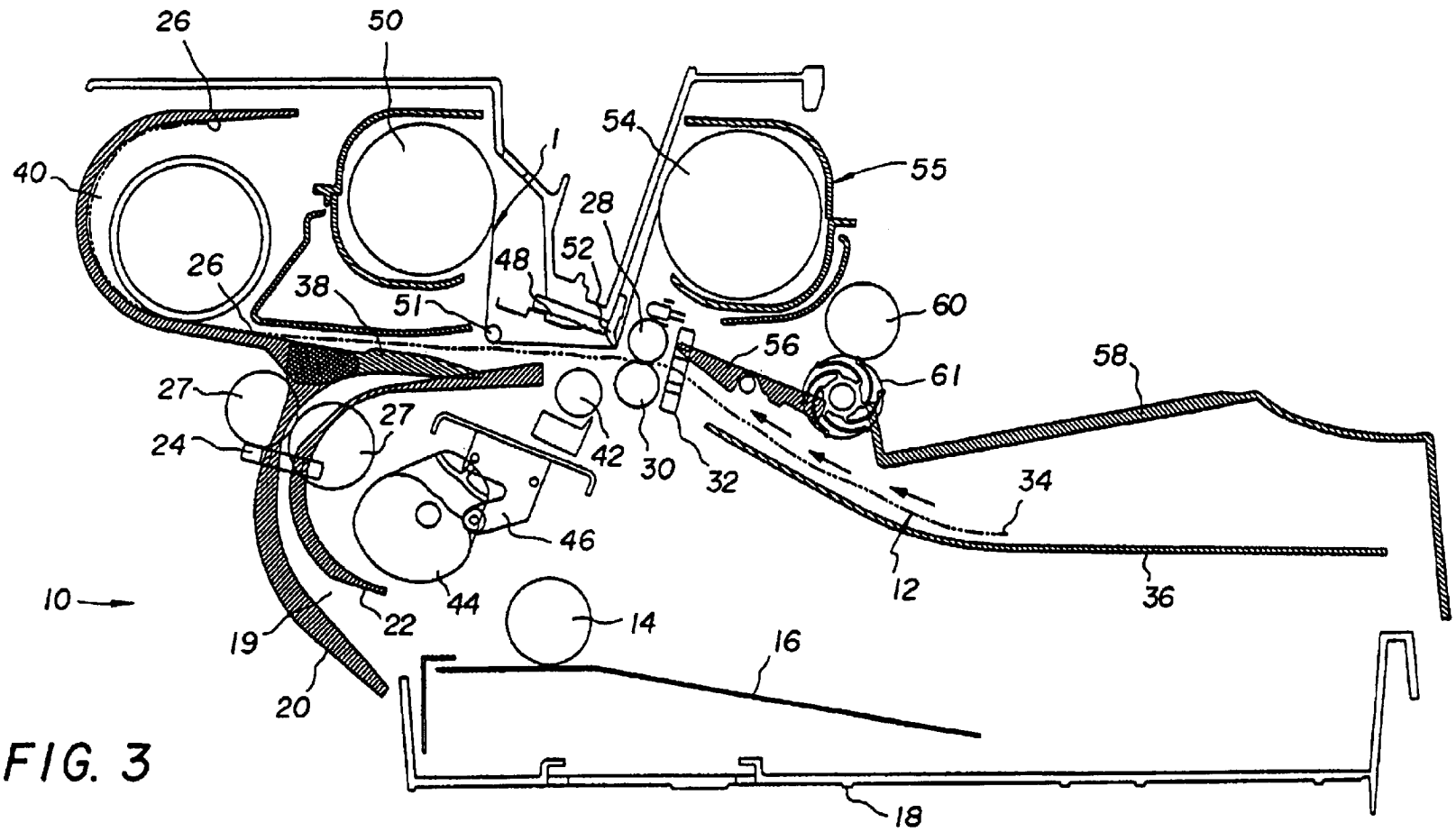
FIGS. 3 and 4 are elevation section views of the dye transfer printer as in FIG. 2, showing successive dye transfer cycles during the printer operation.

In FIG. 3, the leading edge sensor 32 has sensed a leading or front edge 34 of the dye receiver sheet 12 and activated the motorized capstan roller 28 to cause that roller and the pinch roller 30 to advance the receiver sheet forward partially onto an intermediate tray 36. The receiver sheet 12 is advanced forward onto the intermediate tray 36 so that the trailing or rear edge 26 of the receiver sheet can be moved beyond a hinged exit door 38 which is a longitudinal extension of the curved guide 20. Then, as illustrated, the hinged exit door 38 closes and the capstan and pinch rollers 28 and 30 are reversed to advance the receiver sheet 12 rearward, i.e. rear edge 26 first, partially into a rewind chamber 40.

Successive Yellow, Magenta and Cyan Dye Transfers

To make a multi-color image print, respective color dyes in the dye transfer areas 5 of a single series of yellow, magenta and cyan color sections 2, 3 and 4 on the donor web 1 must be successively heat-transferred in superimposed relation onto the dye receiver sheet 12. This is shown beginning in FIG. 4.

Figure 4:
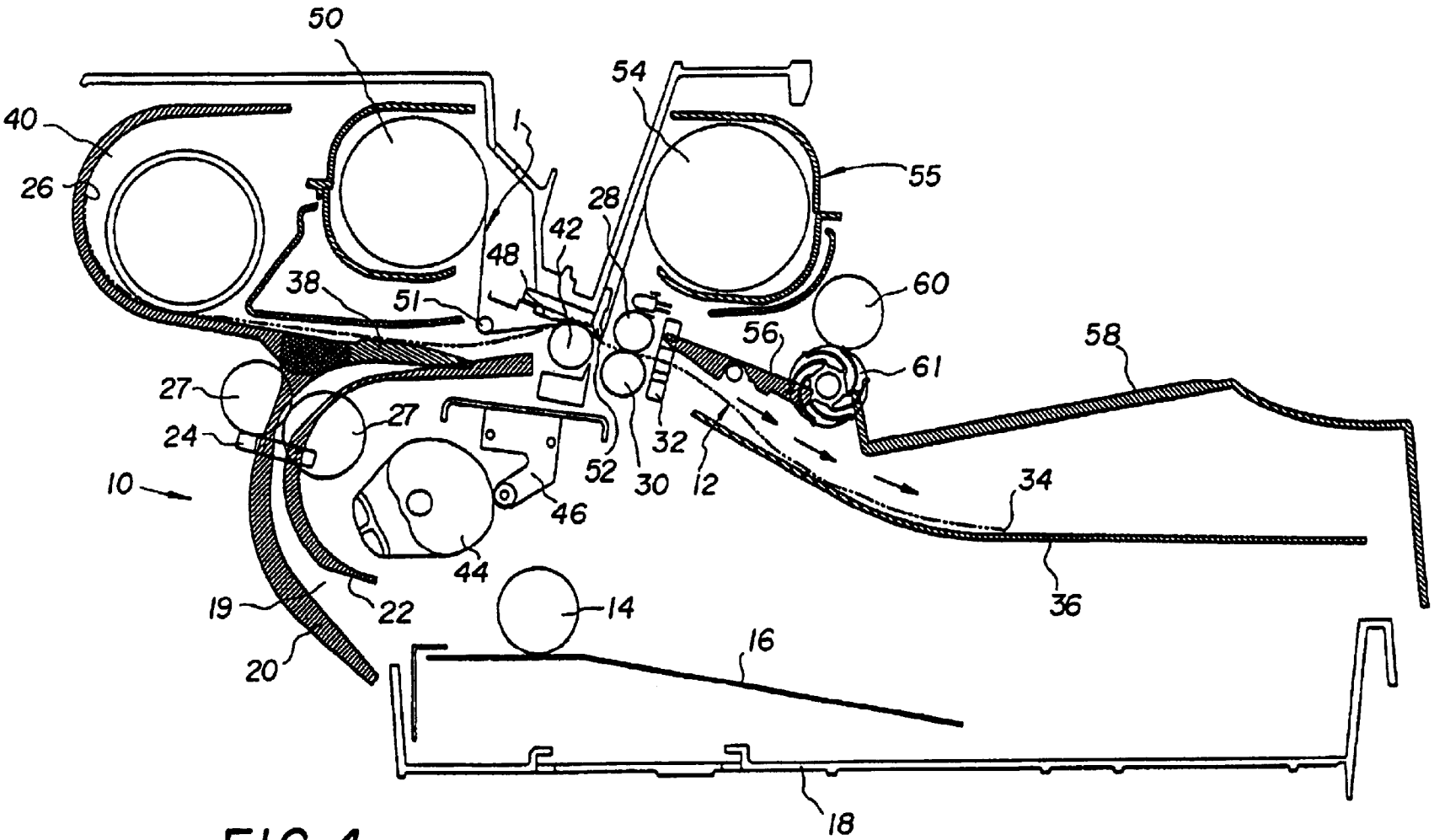

In FIG. 4, a platen roller 42 is shifted via a rotated cam 44 and a platen lift 46 to adjacent a thermal print head 48. This causes the dye receiver sheet 12 and an unused (fresh) yellow color section 2 of the donor web 1 to be locally held together between the platen roller 42 and the print head 48. The motorized capstan roller 28 and the pinch roller 30 are reversed to again advance the dye receiver sheet 12 forward to begin to return the receiver sheet to the intermediate tray 36. At the same time, the donor web 1 is moved forward from a donor supply spool 50, over a first stationary web guide 51, the print head 48, and a second stationary web guide or guide nose 52. This is accomplished by a motorized donor take-up spool 54 that pulls or draws the donor web forward. The donor supply and take-up spools 50 and 54 together with the donor web 1 may be provided in a replaceable cartridge 55 that is loaded into the printer 10.

Figure 7:
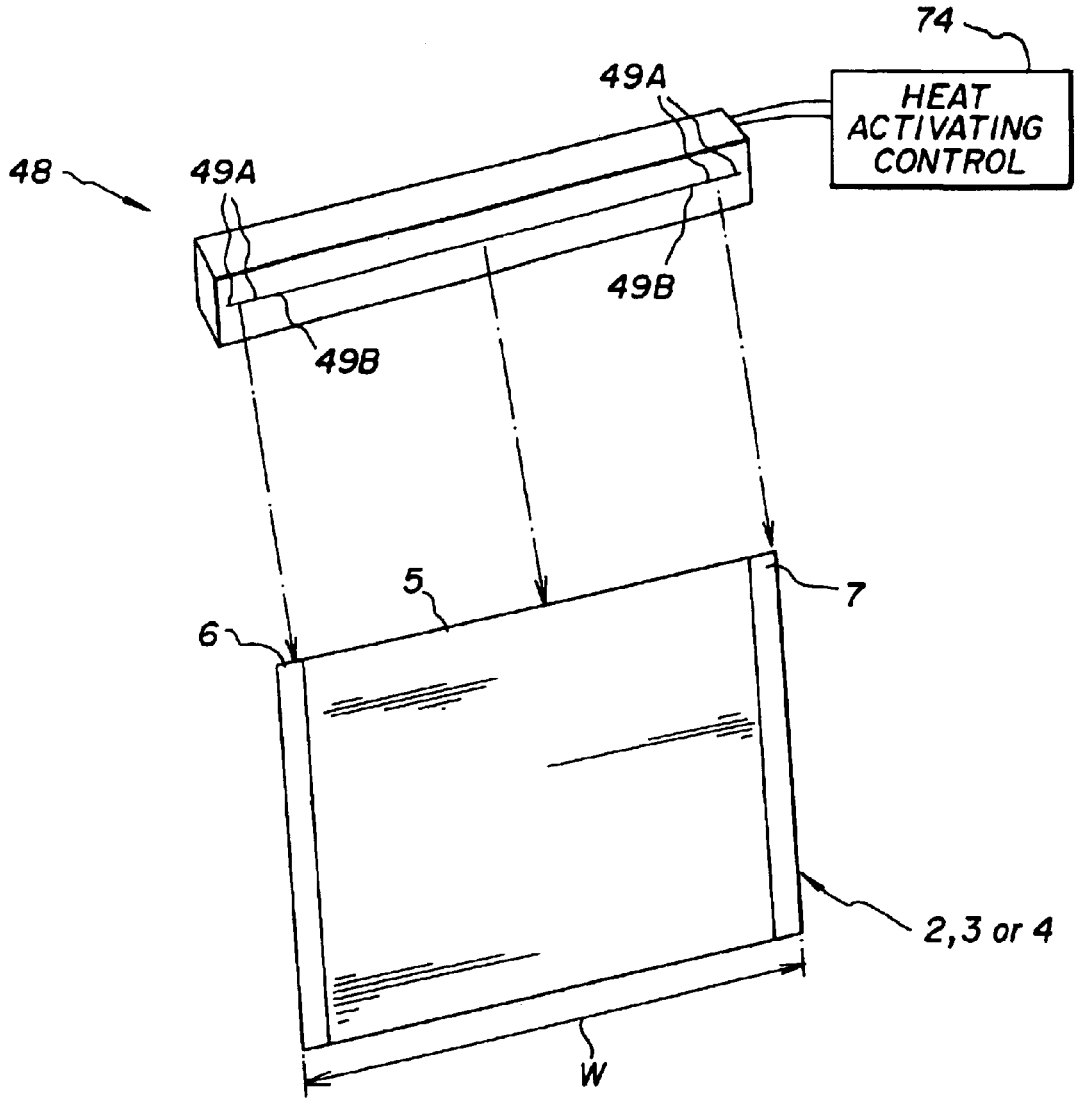
FIG. 7 is a perspective view of a bead of selectively heated resistive elements on a print head in the dye transfer printer.

When the yellow color section 2 of the donor web 1 is moved forward over the print head 48 in FIG. 4, the yellow color dye in the dye transfer area 5 of that color section is heat-transferred onto the dye receiver sheet 12. The yellow color dye in the two edge areas 6 and 7 of the yellow color section 2, which are alongside the dye transfer area 5, is not heat-transferred onto the dye receiver sheet 12. In this connection, the print head 48 has a bead of selectively heated, closely spaced, resistive elements 49A, 49A, . . . , 49B, 49B, . . . , 49A, 49A, . . . on the print head 48 that make contact across the entire width W of the yellow color section 2, i.e. across its dye transfer area 5 and the two edge areas 6 and 7 alongside the transfer area. As shown in FIG. 7, the resistive elements 49A make contact with the edge areas 6 and 7 and the resistive elements 49B make contact 5 with the dye transfer area 5. However, only the resistive elements 49B are selectively heated to effect the yellow dye transfer from the dye transfer area 5 to the dye receiver sheet 12. The yellow dye transfer is done line-by-line, i.e. row-by-row, widthwise across the dye transfer area 5. The resistive elements 49A are not heated so that there is no yellow dye transfer from the edge areas 6 and 7 to the dye receiver sheet 12.

Figure 5:
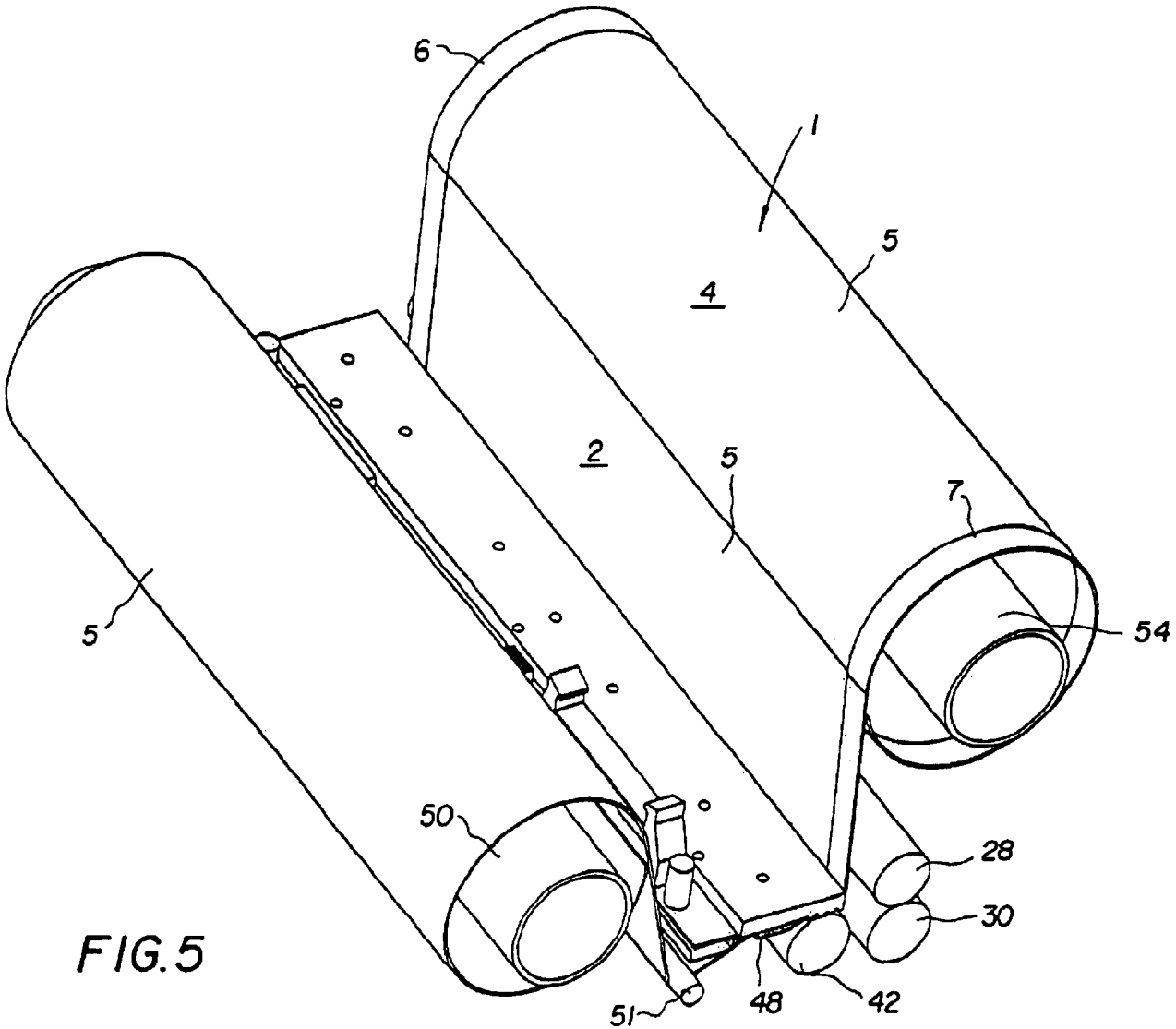
FIG. 5 is perspective view of a printing or dye transfer station in the dye transfer printer.

As the yellow color section 2 of the donor web 1 is used for dye transfer line-by-line, it moves forward from the print head 48 and over the guide nose 52 in FIGS. 4 and 5. Then, once the yellow dye transfer onto the dye receiver sheet 12 is completed, the platen roller 42 is shifted via the rotated cam 44 and the platen lift 46 from adjacent the print head 48 to separate the platen roller from the print head, and the motorized capstan 28 and the pinch roller 30 are reversed to advance the dye receiver sheet rearward, i.e. trailing or rear edge 26 first, partially into the rewind chamber 40. See FIG. 3.

Then, the dye transfer onto the dye receiver sheet 12 is repeated in FIG. 4, but this time using an unused (fresh) magenta color section 3 of the donor web 1 to heat-transfer the magenta color dye from the dye transfer area 5 of that color section onto the dye receiver sheet. The magenta dye transfer is superimposed on the yellow dye transfer on the dye receiver sheet 12.

Once the magenta dye transfer onto the dye receiver sheet 12 is completed, the platen roller 42 is shifted via the rotated cam 44 and the platen lift 46 from adjacent the print head 48 to separate the platen roller from the print head, and the motorized capstan 28 and the pinch roller 30 are reversed to advance the dye receiver sheet rearward, i.e. trailing or rear edge 26 first, partially into the rewind chamber 40. See FIG. 3.

Then, the dye transfer onto the dye receiver sheet 12 is repeated in FIG. 4, but this time using an unused (fresh) cyan color section 3 of the donor web 1 to heat-transfer the cyan color dye from the dye transfer area 5 of that color section onto the dye receiver sheet. The cyan dye transfer is superimposed on the magenta and yellow dye transfers on the dye receiver sheet 12.

Once the cyan dye transfer onto the dye receiver sheet 12 is completed, the platen roller 42 is shifted via the rotated cam 44 and the platen lift 46 from adjacent the print head 48 to separate the platen roller from the print head, and the motorized capstan roller 28 and the pinch roller 30 are reversed to advance the dye receiver sheet rearward, i.e. trailing or rear edge 26 first, partially into the rewind chamber 40. See FIG. 3.

Final

Figure 6:
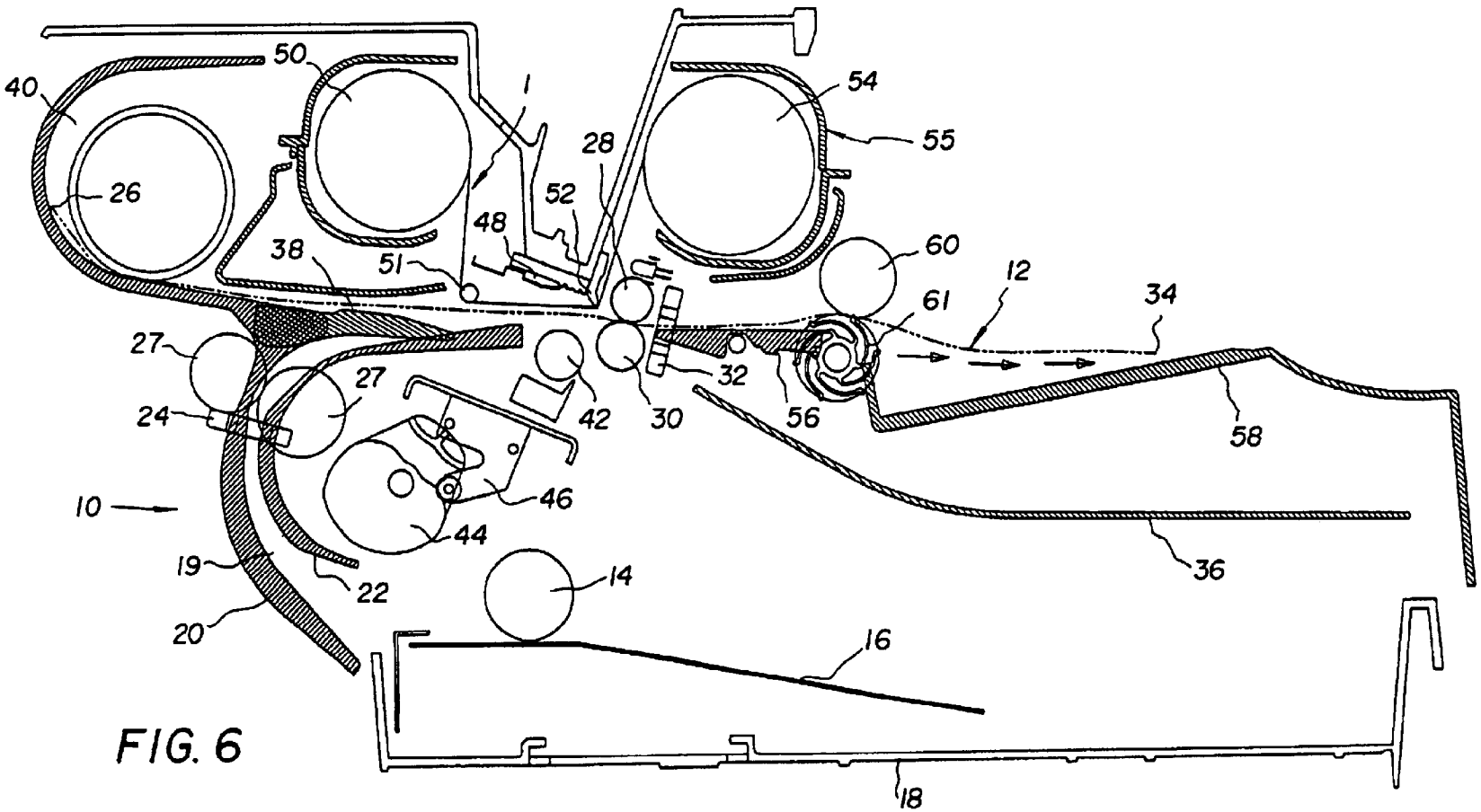
FIG. 6 is an elevation section view of the dye transfer printer as in FIG. 2, showing a final cycle during the printer operation.

Finally, as shown in FIG. 6, the platen roller 42 remains separated from the print head 48 and the motorized capstan roller 28 and the pinch roller 30 are reversed to advance the dye receiver sheet 12 forward. However, in this instance a diverter 56 is pivoted to divert the dye receiver sheet 12 to an exit tray 58 instead of returning the receiver sheet to the intermediate tray 36 as in FIG. 4. A pair of parallel axis exit rollers 60 and 62 aid in advancing the receiver sheet 12 into the exit tray 58.

Prior Art Problem

Figure 8:
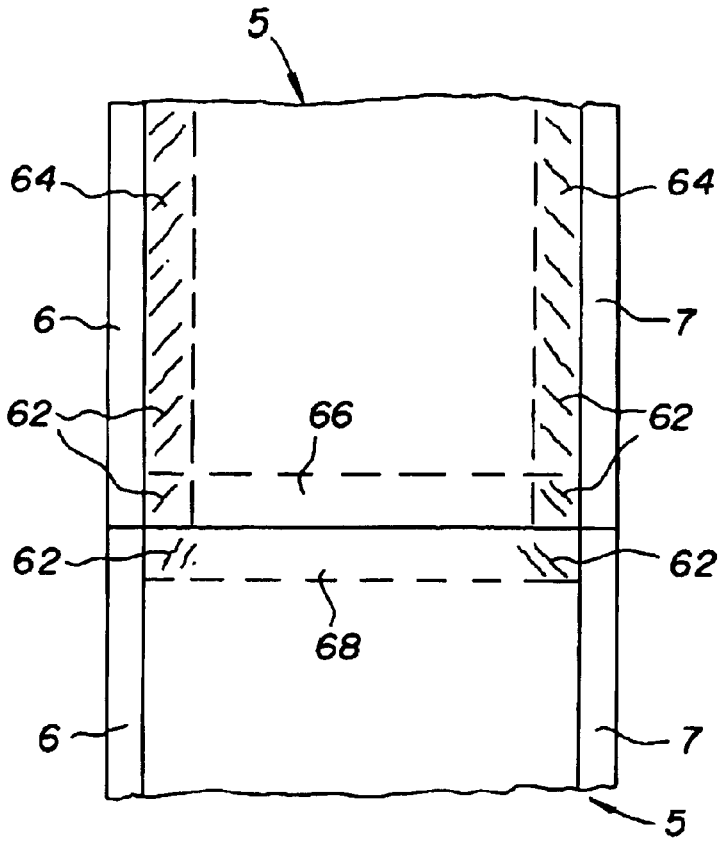
FIG. 8 PRIOR ART
FIG. 8 is a plan view of a portion of the donor web as in FIG. 1, showing creases or wrinkles spreading rearward from a trailing or rear end portion of a used transfer area into a leading or front end portion of an unused transfer area in the next (fresh) color section to be used, as in the prior art.

Typically in prior art dye transfer, as each yellow, magenta and cyan color section 2, 3 and 4, including its dye transfer area 5 and the two edge areas 6 and 7 alongside the transfer area, is advanced over the bead of selectively heated resistive elements 49A, 49A, . . . , 49B, 49B, . . . , 49A, 49A, . . . , the color section is subjected to a longitudinal tension imposed substantially by a uniform or substantially uniform pulling force of the motorized donor take-up spool 54. Moreover, since the dye transfer area 5 is heated by the resistive elements 49B, but the two edge areas 6 and 7 alongside the transfer area are not heated by the resistive elements 49A, the dye transfer area is significantly weakened in relation to the two edge areas and therefore becomes more susceptible or vulnerable to being stretched than the edge areas. Consequently, the longitudinal tension imposed by the pulling force of the motorized take-up s pool 54 will stretch the dye transfer area 5 relative to the two edge areas 6 and 7. This stretching causes the dye transfer area 5 to become thinner than the non-stretched edge areas 6 and 7, which in turn causes creases or wrinkles 62 to develop in the dye transfer area, particularly in those regions 64 of the transfer area that are close to the two edge areas. See FIG. 8. The longitudinal creases or wrinkles 62 are most notable in the regions 64 of the dye transfer area 5 that are close to the two edge areas 6 and 7 because of the sharp, i.e. abrupt, transition between the weakened transfer area and the stronger edge areas, and they may be inclined by as much as 45° as shown in FIG. 8.

As the dye donor web 1 is advanced, the creases or wrinkles 62 tend to spread or extend from a trailing or rear end portion 66 of a used dye transfer area 5 at least to a leading or front end portion 68 of the next dye transfer area to be used. See FIG. 8. A problem that can result is that a crease or wrinkle 62 in the leading or front end portion 68 of the next dye transfer area 5 to be used will cause an undesirable line artifact 70 to be printed on a leading or front end portion 72 of the dye receiver sheet 12 when dye transfer occurs at the crease. See FIG. 9. The line artifact 70 printed on the dye receiver sheet 12 is relatively short, but quite visible.

Figure 9:
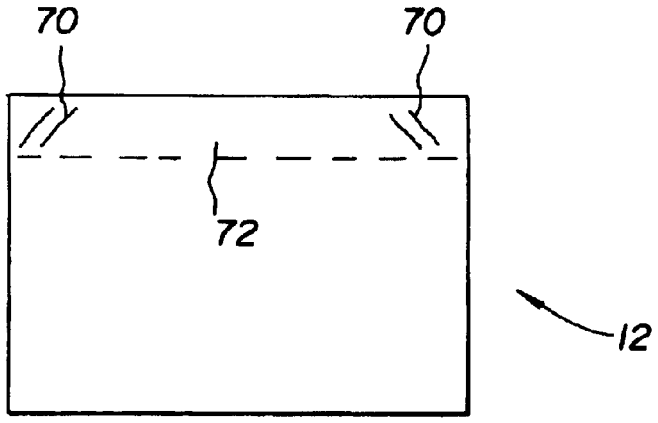
FIG. 9 PRIOR ART
FIG. 9 is a plan view of a dye receiver sheet, showing line artifacts printed on a leading or front edge portion of the dye receiver sheet, as in the prior art.

The question presented therefore is how to solve the problem of the creases or wrinkles 62 being created in an unused transfer area 5 so that no line artifacts 70 are printed on the dye receiver sheet 12 as in FIG. 9.

Solution

As previously mentioned, during successive yellow, magenta and cyan dye transfers onto the dye receiver sheet 12 in the thermal printer 10, the resistive elements 49B make contact across the dye transfer area 5 and the resistive elements 49A make contact across the two edge areas 6 and 7 alongside the dye transfer area. However, only the resistive elements 49B are selectively heated. The resistive elements 49A are not heated. Thus, the dye transfer area 5 becomes more susceptible or vulnerable to being stretched than the two edge areas 5 and 6 alongside the dye transfer area.

A known heat activating control 74, preferably including a suitably programmed microcomputer using known programming techniques, is connected individually to the resistive elements 49A, 49A, . . . , 49B, 49B, . . . , 49A, 49A, . . . , to selectively heat those resistive elements 49B that make contact with the dye transfer area 5 and not heat those resistive elements 49A that make contact with the two edge areas 6 and 7 alongside the dye transfer area See FIG. 7.

As previously mentioned, before each yellow, magenta or cyan dye transfer onto the dye receiver sheet 12, the platen roller 42 is shifted via the rotated cam 44 and the platen lift 46 to adjacent the print head 48. This causes the dye receiver sheet 12 and an unused (fresh) color section 2, 3 or 4 of the donor web 1 to be locally held together between the platen roller 42 and the print head 48.

Figure 11:
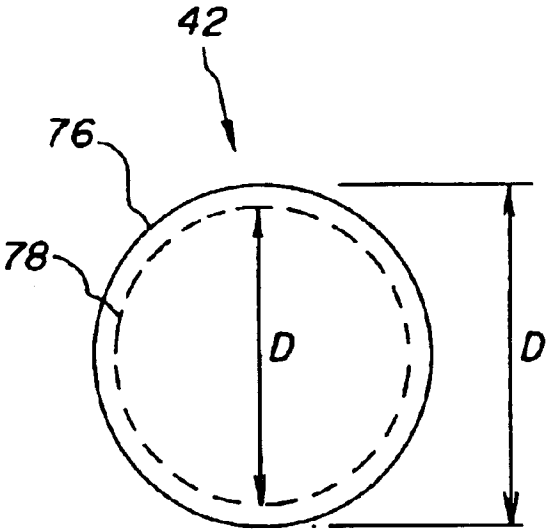
FIG. 11 is an end view of the platen roller as in FIG. 10.
Figure 10:
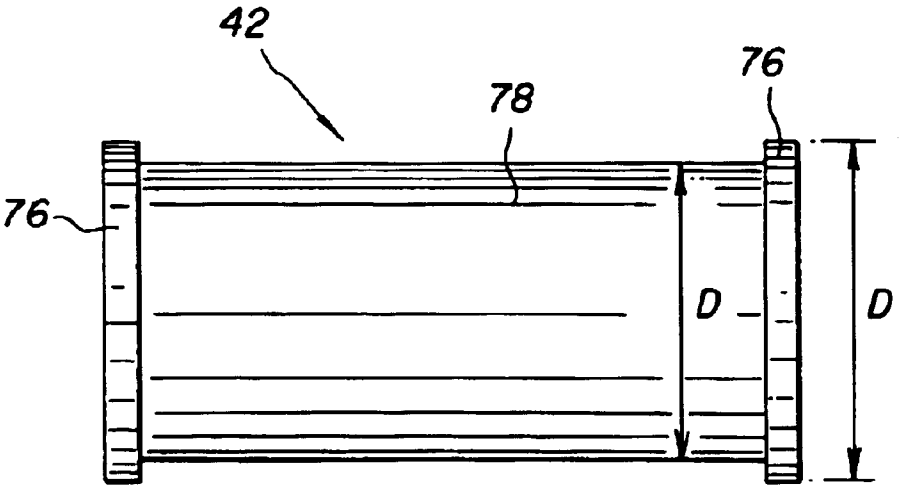
FIG. 10 is an elevation view of a platen roller in the dye transfer printer according to a preferred embodiment of the invention, showing the platen roller in a non-deformed or normal condition when it is not being used.

As shown in FIGS. 10 and 11, the platen roller 42 has a diameter D and a compliance, i.e. an ability to yield elastically, that is greater at opposite roller end portions 76, 76 than at a roller main portion 78. The roller end portions 76, 76 may have a rubber hardness of Shore A in the range of 30–80 and the roller main portion 78 may have a rubber hardness of Shore A in the range of 40–90 to make the roller end portions more compliant than the roller main portion.

When the platen roller 42 is shifted via the rotated cam 44 and the platen lift 46 to adjacent the print head 48 as in FIG.

Figure 13:
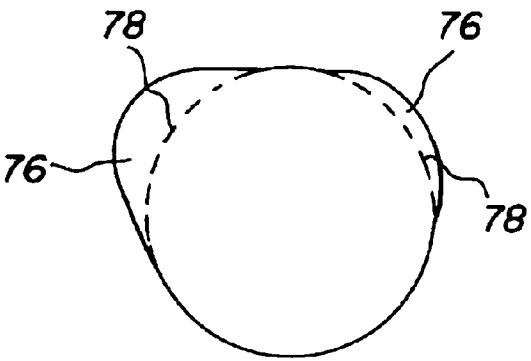
FIG. 13 is an end view of the platen roller as in FIG. 12.
Figure 12:
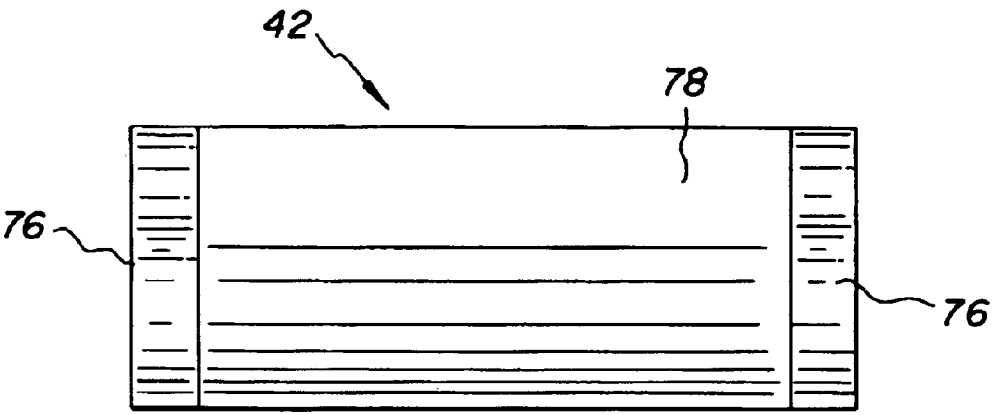
FIG. 12 is an elevation view of the platen roller, showing the platen roller in a deformed condition when it is being used.

4, the roller main portion 78 is positioned to hold the dye transfer area 5 against the resistive element s 49B and the roller edge portions 76, 76 are positioned to hold the two edge areas 6 and 7 alongside the dye transfer area against the resistive elements 49A. Since the roller end portions 76, 76 have a diameter D and a compliance, i.e. an ability to yield elastically, that is greater than the diameter D and compliance of the roller main portion 78, the roller end portions are deformed more than the roller main portion to thereby provide a larger contact area. See FIGS. 12 and 13. The roller end portions 76, 76 then apply a pressure against the two edge areas 6 and 7 that is greater than a pressure the roller main portion 78 applies against the dye transfer area 5. This difference in the pressure application causes the two edge areas 6 and 7 to be stretched substantially the same as the dye transfer area 5 when the edge areas and dye transfer area are subjected to the longitudinal tension imposed by the pulling force of the motorized donor take-up spool 54. As a result, the edge areas 6 and 7 are stretched substantially the same as the dye transfer area 8. In other words, there is no reduction in stretching from the dye transfer area 5 to the edge areas 6 and 7 that would form the creases or wrinkles 62 in the dye transfer area which would produce the line artifacts 70 on the dye receiver sheet 12 as in FIGS. 8 and 9.

Since the roller end portions 76, 76 apply a pressure against the two edge areas 6 and 7 that is greater than a pressure the roller main portion 78 applies against the dye transfer area 5, the resistance, drag, or motion-retarding opposition, at the two edge areas 6 and 7 to the pulling force of the donor take-up spool 54, i.e. the friction between the two edge areas and the print head 48, is made sufficient to increase stretching of the two edge,areas to match stretching of the dye transfer area 5 by the same pulling force.

The invention has been described in detail with particular reference to certain preferred embodiments thereof, but it will be understood that variations and modifications can be effected within the spirit and scope of the invention.

Parts List

1. donor web
2. cyan color section
3. magenta color section
4. yellow color section
5. dye transfer area
6. longitudinal edge area
7. longitudinal edge area
W. web width
10. thermal dye transfer printer
12. dye receiver sheet
14. pick rollers
16. platen
18. tray
19. channel
20. longitudinal guide
22. longitudinal guide
24. trailing edge sensor
26. trailing edge
27. urge rollers
28. capstan roller
30. pinch roller
32. leading edge sensor
34. leading or front edge
36. intermediate tray
38. exit door
40. rewind chamber
42. platen roller
44. cam
46. platen lift
48. thermal print head
49A, 49B. resistive elements
50. donor supply spool
51. first stationary (fixed) web guide
52. second stationary (fixed) web guide or guide nose
54. donor take-up spool
55. cartridge
56. diverter
58. exit tray
60. exit roller
61. exit roller
62. creases or wrinkles
64. regions
66. trailing or rear end portion
68. leading or front end portion
70. line artifacts
72. leading or front end portion
74. heat activating control
D. diameter
76, 76. roller end portions
78. roller main portion

What is claimed is:

1. A method of preventing crease formation in a dye transfer area of a dye donor web that can cause line artifacts to be printed on a dye receiver during a dye transfer from the dye transfer area to the dye receiver in a dye transfer printer, said method comprising:

heating the dye transfer area of the dye donor web sufficiently to effect a dye transfer from the dye transfer area to the dye receiver, and not heating opposite edge areas of the dye donor web alongside the dye transfer area sufficiently to effect a dye transfer from the edge areas to the dye receiver, but which therefore causes the dye transfer area to become more susceptible to being stretched than the edge areas; and mechanically causing the edge areas to be stretched substantially the same as the dye transfer area by mechanically creating a resistance at the edge areas to the pulling force that is sufficient to increase stretching of the edge areas by the pulling force to match stretching of the dye transfer area by the pulling force, when the dye transfer area and edge areas are subjected to a pulling force that tends to stretch the dye transfer area and edge areas, to avoid a reduction in stretching from the dye transfer area to the edge areas that would form creases in the dye transfer area which can cause line artifacts to be printed on the receiver medium.

2. A method as recited in claim 1, wherein mechanically creating the resistance at the edge areas to the pulling force that is sufficient to increase stretching of the edge areas by the pulling force to match stretching of the dye transfer area by the pulling force, is done by applying respective pressures against the dye transfer area and the edge areas to hold the dye transfer area and edge areas against a thermal print head during the dye transfer from the dye transfer area to the receiver medium, but making the pressure applied against the edge areas sufficiently greater than the pressure applied against the dye transfer area to increase stretching of the edge areas by the pulling force to match stretching of the dye transfer area by the pulling force.

3. A method of preventing crease formation in a dye transfer area of a dye donor web that can cause line artifacts to be printed on a dye receiver during a dye transfer from the dye transfer area to the dye receiver in a dye transfer printer, said method comprising:

heating the dye transfer area of the dye donor web sufficiently to effect a dye transfer from the dye transfer area to the dye receiver, and not heating opposite edge areas of the dye donor web alongside the dye transfer area sufficiently to effect a dye transfer from the edge areas to the dye receiver, but which therefore causes the dye transfer area to become more susceptible to being stretched than the edge areas; and mechanically causing the edge areas to be stretched substantially the same as the dye transfer area by applying a motion-retarding force against the edge areas that is sufficient to increase stretching of the edge areas by the pulling force to match stretching of the dye transfer area by the pulling force, when the dye transfer area and edge areas are subjected to a pulling force that tends to stretch the dye transfer area and edge areas, to avoid a reduction in stretching from the dye transfer area to the edge areas that would form creases in the dye transfer area which can cause line artifacts to be printed on the receiver medium.

4. A method of preventing crease formation in a dye transfer area of a dye donor web that can cause line artifacts to be printed on a dye receiver during a dye transfer from the dye transfer area to the dye receiver in a dye transfer printer, said method comprising:

heating the dye transfer area of the dye donor web sufficiently to effect a dye transfer from the dye transfer area to the dye receiver, and not heating opposite edge areas of the dye donor web alongside the dye transfer area sufficiently to effect a dye transfer from the edge areas to the dye receiver, but which therefore causes the dye transfer area to become more susceptible to being stretched than the edge areas; and mechanically causing the edge areas to be stretched substantially the same as the dye transfer area, is done by inducing a friction between the edge areas and a thermal print head that is sufficient to increase stretching of the edge areas by the pulling force to match stretching of the dye transfer area by the pulling force, when the dye transfer area and edge areas are subjected to a pulling force that tends to stretch the dye transfer area and edge areas, to avoid a reduction in stretching from the dye transfer area to the edge areas that would form creases in the dye transfer area which can cause line artifacts to be printed on the receiver medium.

5. A method as recited in claim 4, wherein inducing the friction between the edge areas and the thermal print head that is sufficient to increase stretching of the edge areas by the pulling force to match stretching of the dye transfer area by the pulling force, is done by moving a platen roller that has a diameter and a compliance that is greater at opposite roller end portions than at a roller main portion to position the roller main portion to hold the dye transfer area against the thermal print head and position the roller end portions to hold the edge areas against the thermal print head, so that the roller end portions apply a pressure against the edge areas that is greater than a pressure the roller main portion applies against the dye transfer area.

6. A method of preventing crease formation in a dye transfer area of a dye donor web that can cause line artifacts to be printed on a dye receiver during a dye transfer from the dye transfer area to the dye receiver in a dye transfer printer, said method comprising:

heating the dye transfer area of the dye donor web sufficiently at a thermal print head to effect a dye transfer from the dye transfer area to the dye receiver, and not heating opposite edge areas of the dye donor web alongside the dye transfer area sufficiently at the thermal print head to effect a dye transfer from the edge areas to the dye receiver, but which therefore causes the dye transfer area to become more susceptible to being stretched than the edge areas; and moving a platen roller that has a diameter and a compliance that is greater at opposite roller end portions than at a roller main portion to position the roller main portion to hold the dye transfer area against the thermal print head and position the roller end portions to hold the edge areas against the thermal print head, so that the roller end portions apply a pressure against the edge areas that is greater than a pressure the roller main portion applies against the dye transfer area, to cause the edge areas to be stretched substantially the same as the dye transfer area when the edge areas and dye transfer area are subjected to a pulling force that tends to stretch the dye transfer area and edge areas, thereby to avoid a reduction in stretching from the dye transfer area to the edge areas that would form creases in the dye transfer area which can cause line artifacts to be printed on the receiver medium.

7. A thermal printer capable of preventing crease formation in a dye transfer area of a dye donor web that can cause line artifacts to be printed on a dye receiver during a dye transfer from the dye transfer area to the dye receiver, said printer comprising:

a thermal print head adapted to heat the dye transfer area of the dye donor web sufficiently to effect a dye transfer from the dye transfer area to the dye receiver, and not heat opposite edge areas of the dye donor web alongside the dye transfer area sufficiently to effect a dye transfer from the edge areas to the dye receiver, but which therefore causes the dye transfer area to become more susceptible to being stretched than the edge areas; and a platen roller that holds the dye transfer area and the edge areas against said thermal print head during the dye transfer from the dye transfer area to the dye receiver, and which is adapted to mechanically cause the edge areas to be stretched substantially the same as the dye transfer area, when the dye transfer area and edge areas are subjected to a pulling force that tends to stretch the dye transfer area and edge areas, to avoid a reduction in stretching from the dye transfer area to the edge areas that would form creases in the dye transfer area which can cause line artifacts to be printed on the receiver medium.

8. A thermal printer as recited in claim 7, wherein said platen roller has a diameter and a compliance that is greater at opposite roller end portions than at a roller main portion to position said roller main portion to hold the dye transfer area against said thermal print head and position said roller end portions to hold the edge areas against said thermal print head, so that said roller end portions apply a pressure against the edge areas that is greater than a pressure said roller main portion applies against the dye transfer area, to cause the edge areas to be stretched substantially the same as the dye transfer area when the edge areas and dye transfer area are subjected to the pulling force.

9. A thermal printer as recited in claim 8, wherein said roller end portions have a rubber hardness of Shore A in the range of 30–80 and said roller main portion has a rubber hardness of Shore A in the range of 40–90 to make said roller end portions more compliant than said roller main portion.

10. A method of preventing crease formation in a dye transfer area of a dye donor web that can cause line artifacts to be printed on a dye receiver during a dye transfer from the dye transfer area to the dye receiver in a dye transfer printer, said method comprising:

heating the dye transfer area of the dye donor web sufficiently to effect a dye transfer from the dye transfer area to the dye receiver, and not heating opposite edge areas of the dye donor web alongside the dye transfer area sufficiently to effect a dye transfer from the edge areas to the dye receiver, but which therefore causes the dye transfer area to become more susceptible to being stretched than the edge areas; and mechanically causing the edge areas to be stretched substantially the same as the dye transfer area without heating such edge areas, when the dye transfer area and edge areas are subjected to a pulling force that tends to stretch the dye transfer area and edge areas, to avoid a reduction in stretching from the dye transfer area to the edge areas that would form creases in the dye transfer area which can cause line artifacts to be printed on the receiver medium.

* * * * *